US006222497B1

(12) United States Patent
Hu et al.

(10) Patent No.: US 6,222,497 B1
(45) Date of Patent: Apr. 24, 2001

(54) ANTENNA DEVICE

(75) Inventors: Annika Yidong Hu, Åkersberga; Ola Skogsfors, Johanneshov, both of (SE)

(73) Assignee: SMARTEQ Wireless AB, Enebyberg (SE)

( * ) Notice: Subject to any disclaimer, the term of this patent is extended or adjusted under 35 U.S.C. 154(b) by 0 days.

(21) Appl. No.: 09/441,558

(22) Filed: Nov. 17, 1999

(30) Foreign Application Priority Data

Nov. 20, 1998 (SE) ..... 9803983

(51) Int. Cl.[7] ..... H01Q 1/32
(52) U.S. Cl. ..... 343/846; 343/713
(58) Field of Search ..... 343/702, 700 MS, 343/846, 848, 713; H01Q 1/32, 1/38

(56) References Cited

U.S. PATENT DOCUMENTS 4,771,291 * 9/1988 Lo et al. ..... 343/700 MS
5,148,181 * 9/1992 Yokoyama et al. ..... 343/702
5,600,337 * 2/1997 Cassel ..... 343/846
5,734,350 * 3/1998 Deming et al. ..... 343/700 MS
5,929,812 * 7/1999 Aminzadeh ..... 343/846

FOREIGN PATENT DOCUMENTS 19616974 10/1997 (DE) .
0821429 1/1998 (EP) .
0841715 5/1998 (EP) .
0856907 8/1998 (EP) .
10016646 1/1998 (JP) .
WO97/44856 11/1997 (WO) .

* cited by examiner

*Primary Examiner*—Michael C. Wimer
(74) *Attorney, Agent, or Firm*—Jacobson, Price, Holman & Stern, PLLC

(57) ABSTRACT

An antenna device for a radio communication device, comprises a ground plane (1), connected to a conductive second plate (2) by means of a conductive grounding means (9). Between the ground plane (1) and the second plate (2) a conductive third plate (3) is arranged. The third plate (3) is provided with a feed portion (35), which is to be connected to circuitry of the radio communication device, whereby it is achieved that received/transmitted signals in a first frequency band, are capacitively coupled between the second (2) and third (3) plates.

20 Claims, 4 Drawing Sheets

ANTENNA DEVICE

BACKGROUND OF THE INVENTION

1. Field of the Invention

The invention relates to an antenna device for a radio communication device, comprising a conductive first plate, having a first surface, being arranged to be connected to signal ground of the radio communication device; a conductive second plate, having first and second opposing edges partially limiting a second surface of the second plate, being arranged spaced apart from the first plate, the first and second surfaces facing each other; and a conductive grounding means interconnecting the first and second plates at least along a portion of the first edge of the second plate.

Especially it relates to an antenna device including a housing cover to be attached to a glass pane, e.g. a top portion of a wind screen or a back window of an automobile.

2. Related Art

WO-A1-97/44856 and EP-A1-0856907 disclose antenna devices of the type described in the first paragraph above. Those antenna devices are aperture-coupled planar antenna devices for mobile radio communication devices, e.g., hand-portable telephones. Antenna devices therein are fed by a feed conductor exciting an aperture, creating an electromagnetic field across the aperture. They can be made small and compact so as to fit in a mobile radio communication device, such as a hand-portable telephone. It is well known that the size of an antenna is critical for its performance (see Johnsson, Antenna Engineering Handbook, McGrawHill 1993, chapter 6). This can be expressed as a limitation of the product of the relative bandwidth ($\Delta f/f$) and the efficiency ($\eta$), which always is smaller than a constant multiplied by the efficient volume (V) of the antenna (as expressed in cubic wavelengths):

$$(\Delta f/f)\eta < \text{constant}(V/\lambda^3)$$

It is therefore important for small antennas that the available volume is effectively used.

Further it is disclosed through EP-A2-0 821 429, JP-A-10016646, EP-A2-0 841 715, and DE-A1-196 16 974 different solutions of how to accommodate an antenna device close to a glass pane or similar in an automobile. These antenna devices do not appear to be very efficient or they are of a complicated construction, which makes them complicated to manufacture. Further, they only provide single band operation.

SUMMARY OF THE INVENTION

It is an object of the invention to obtain an efficient antenna device, which is compact and with which the occupied space can be more efficiently used.

It is also an object of the invention to provide an efficient antenna device, which is compact and which can be adapted to efficiently use the available space.

It is a further object of the invention to provide an antenna device, which is suitable for cost effective production in large quantities.

These objects are attained by an antenna means according to the an antenna device for a radio communication device, comprising: a conductive first plate having a first surface and being arranged to be connected to signal ground of the radio communication device. There is a conductive second plate (2), having first (21) and second (22) opposing edges partially limiting a second surface **(2*b*) of the second plate (2), and being arranged spaced apart from the first plate (1). The first (1*a*) and second (2*b*) surfaces are facing each other. A conductive grounding means (9) interconnects the first and second plates (1,2) at least along a portion of the first edge (21) of the second plate (2), wherein a conductive third plate (3), having third (33) and fourth (34) opposing edges, is arranged between the first and second plates (1,2). The third plate (3) is provided with a feed portion (35), which is connected to circuitry of the radio communication device. In the invention, the received and transmitted signals in a first frequency band are capacitively coupled between the second (2) and third (3) plates, and the second plate (2) essentially performs the radiating function of the antenna device in the first frequency band. The third edge (33) is the edge of the third plate (3) arranged closest to the grounding means (9)**, and with a spacing therebetween.

The antenna device includes that the feed portion (35) is located in vicinity of the third edge (33).

The antenna device of the invention has the third plate (3) conductively connected to the first plate (1) at least along a portion of the fourth edge (34) of the third plate (3).

The antenna device of the invention has the third plate (3) arranged on the first plate (1) by means of a dielectric carrier (6), whereby a capacitive coupling between the third plate (3) and signal ground is achieved.

The antenna device of the invention has the first (21) and third (33) edges essentiall parallel.

The antenna device of the invention has the third plate located closer to the first plate (1) than to the second plate (2).

The antenna device of the invention has the third plate (3) fully overlapped by the second plate (2).

The antenna device of the invention has the third plate (3) connected, at an edge (36) between opposing ends of the third (33) and fourth (34) edges, to a conductive fourth plate (4), whereby it is achieved that the received and transmitted signals in a second frequency band are transmitted by the fourth plate (4) and the first plate (1).

The antenna device of the invention has the fourth plate (4) essentially not overlapped by the second plate (2).

The antenna device of the invention has the second frequency band at a center frequency approximately twice that of the first frequency band.

In the antenna device of the invention, the second plate. (2) is essentially rectangular, and the lengths of the first (21) and second edges (22), respectively, are smaller than the distance between said edges.

In the antenna device of the invention, the first (1) and second (2) plates are essentially parallel.

The antenna device of the invention has the first (1) and second (2) plates in essentially a plane, and that the planes of respective plate intersect at an angle , where 0°( ≦45°, and preferably 8°( ≦25°.

The antenna device wherein is about 10°.

The antenna device wherein the first (1), second (2), and third (3) plates are formed from one conductive sheet, and the first (21) and fourth (34) edges are formed by bent sections of said sheet.

The antenna device wherein the third plate (3) is cut out from a portion of the conductive sheet forming the first plate (1).

The antenna device wherein at least one of the conductive plates is provided with stabilizing longitudinal grooves.

The antenna device wherein a cover (7) is attached to at least one of the first plate (1), the second plate (2), or the conductive grounding means (9), and the cover (7) has one open side, possibly covered with a lid with the cover being arranged to be attached with the open side towards a glass pane (8) The antenna device wherein the cover (7) exhibits inner walls (71, 72, 73, 74), whereof major portions are covered by a conductive ground surface.

The antenna device wherein at least two of the conductive plates are mechanically secured to each other with a predetermined spacing by means of at least one dielectric support.

By the features of the invention is also achieved an antenna means which can operate in a selected frequency band without complicated matching means.

By the features of the invention is also achieved a compact antenna device which has good directional performance and an advantageous gain.

By the features of the invention is also achieved an antenna means which is suitable for cost effective production in large quantities. The conductive portion of the antenna device can be manufactured by steps of stamping and bending, which are accurate processes through which improved mechanical tolerances are obtained.

By forming the plates of the antenna device from a conductive sheet, a stable antenna device, which is simple to manufacture is achieved.

By providing the antenna device with a cover attached to the conductive parts if the antenna device, a stable and robust antenna device, which is simple to mount and has a favorable appearance is achieved.

By arranging a dielectric support between plates of the antenna device, an antenna device which is very stable and have low sensitivity to vibrations is achieved.

DESCRIPTION OF PREFERRED EMBODIMENTS

Figure 1:
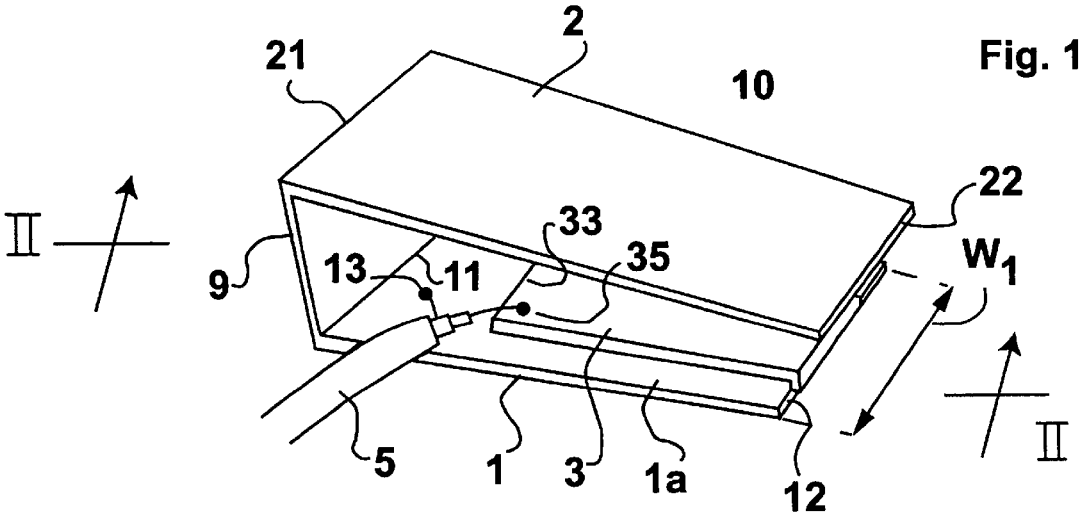
FIG. 1 shows a first embodiment of an antenna device according to the invention.

Referring to FIG. 1, a first embodiment of the invention concerning an antenna device, generally denoted 10, is shown. The antenna device is particularly intended for a radio communication device. By radio communication device is meant a device that can receive and/or transmit radio signals, e.g. a radiotelephone or a GPS receiver, which can be connected directly or via a cable to an antenna device. The antenna device includes a conductive first plate 1, which is to be connected to signal ground of the radio communication device at a connection point 13. A conductive second plate 2 is arranged above the first plate 1, with a spacing between the plates. The projection of the second plate on the plane of the first plate is preferably fully overlapped by the first plate. Possibly the first plate 1, which is a ground plane, extends outside said projection. This can be advantageous since the size of the first plate 1 affects antenna performance and bandwidth. An increased size of the first plate 1, at least by increasing the width $W_1$ up to $\lambda/2$, increases performance and bandwidth of the antenna, where $\lambda$ is a wavelength of signals to be transmitted/received. Also the directivity of the radiation pattern is affected by the size of the first plate or ground plane 1, as well as by the distance between the first and second plates. A large ground plane and a small distance between the first and second plates results in that the antenna device mainly radiates from the second plate in directions away from the first plate.

The first and second plates are conductively connected at first edges 11 and 21, respectively, by means of a conductive grounding means 9. At an edge 12 opposed to the first edge 11, the first plate or ground plane 1 is connected to a conductive third plate 3. The third plate 3 is arranged essentially parallel with the first plate 1, and is connected to the transceiver circuits of the radio communication device at a feed portion 35 located in the vicinity of a third edge 33 of the third plate. At a fourth edge 34 opposed to the third edge 33, the third plate is connected to the first plate 1. The second 2 and third 3 plates are preferably rectangular. Further the second plate 2 is larger than the third plate 3, which is completely overlapped by the second plate 2.

Figure 2:
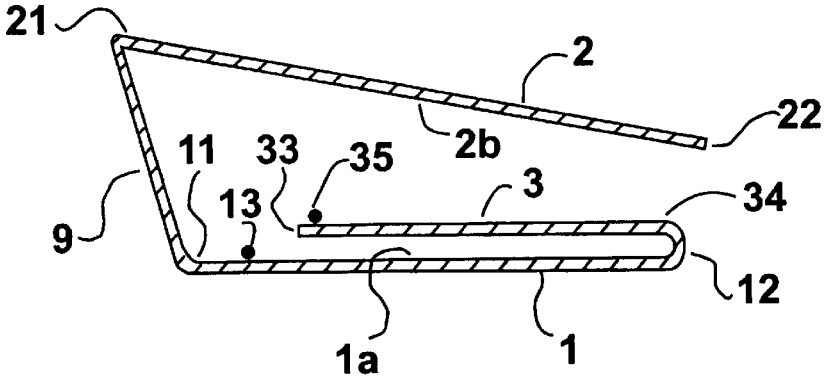
FIG. 2 is a cross section taken at II—II in FIG. 1.

In FIG. 2, a cross section of the antenna device of FIG. 1, taken at II—II, is shown. A first surface 1*a* of the first plate 1 and a second surface 2*b* of the second plate 2 face each other. The plates are preferably plane, and a plane of the first and second plates, respectively, preferably intersect at an angle $\alpha$, where $0° < \alpha \leqq 45°$. The size of the angle depends on the space available for the antenna device. In many applications an angle $8° < \alpha \leqq 25°$ or an angle $\alpha$ being about 10° may be preferable. Other angles than those mentioned are however possible. The plates could e.g. be parallel, as an alternative.

The signals fed to the third plate or hot plate 3 will capacitively couple to the second plate, which will radiate the RF signals, and essentially perform the radiating function of the antenna device. RF signals received by the second plate 2 will be capacitively coupled to the third plate 3, and transmitted to the transceiver circuits of the radio communication device. The distance between the third plate 3 and the second plate 2 affects the center frequency of the frequency band of the antenna device, where an increased distance decreases the center frequency. Also the distance between the first 21 and second 22 edges of the second plate 2, affects the center frequency, as an increase in distance results in a decreased center frequency. Further, the distance between the first 21 and second 22 edges of the second plate 2, and the lengths of the edges, affect the bandwidth and the direction of the gain. Longer edges 21, 22 or wider plate 2 increases the bandwidth. Preferably, the distance between the first 21 and second 22 edges of the second plate 2 is about $\lambda/4$, where $\lambda$ is a wavelength of signals to be transmitted/received.

A capacitance is created between the first plate or ground plane 1 and the third plate 3, as well as an inductance, in the region of the fourth edge 34. This capacitance and this inductance can be adjusted for the antenna device to be matched to the transceiver circuits of the radio communication device, which preferably exhibits an impedance of 50 ohm. Said capacitance can e.g. be adjusted by adjusting the distances, dimensions, shapes or by arranging another dielectric material than air between the plates. This means that no matching circuit is needed, provided that the transmission line has a characteristic impedance of 50 ohm.

Figure 3:
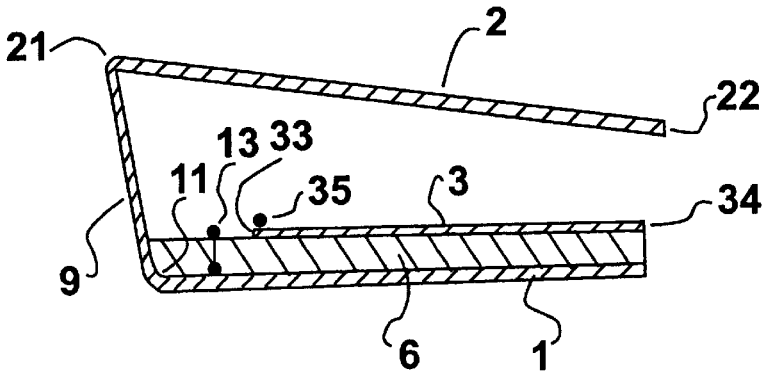
FIG. 3 shows a cross section of a second embodiment of an antenna device according to the invention.

There are several ways how to match an antenna, and the method described in the paragraph above is very suitable at frequencies up to about 900 MHz. For frequencies around 1400 MHz and higher, an embodiment of the invention of which a cross section is shown in FIG. 3 may be more suitable. In this embodiment, the third plate 3 is arranged on the first plate 1 by means of a dielectric support 6. There is no conductive connection between the first 1 and third 3 plates, which results in a very small, if any, inductance between the two plates.

The embodiment of FIG. 1 is preferably manufactured by stamping out the conductive portions in one piece from a metal sheet, and bending the work piece to the final shape. The connections at the connection point 13 and the feed portion 35 can be obtained by soldering or by the arrangement of connection means.

Figure 4:
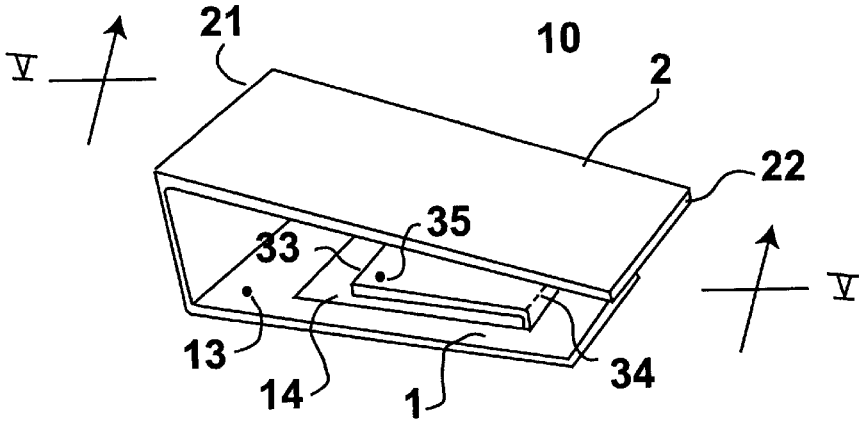
FIGS. 4 shows a third embodiment of an antenna device according to the invention.

In FIG. 4, a third embodiment of the invention is shown. In this embodiment the third plate 3 and means for its connection to the first plate is cut out from the first plate 1, which exhibits a corresponding opening 14. This embodiment is preferably manufactured in a similar way as described above, where the third plate is cut out in the stamping step.

Figure 5:
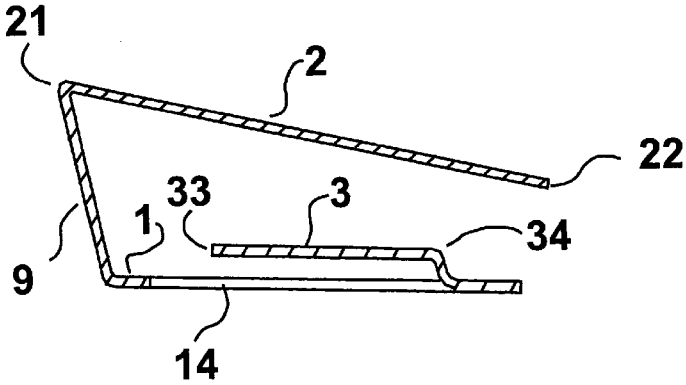
FIG. 5 is a cross section taken at V—V in FIG. 4.

A cross section of the embodiment of FIG. 4, taken at V—V is shown in FIG. 5.

Figure 6:
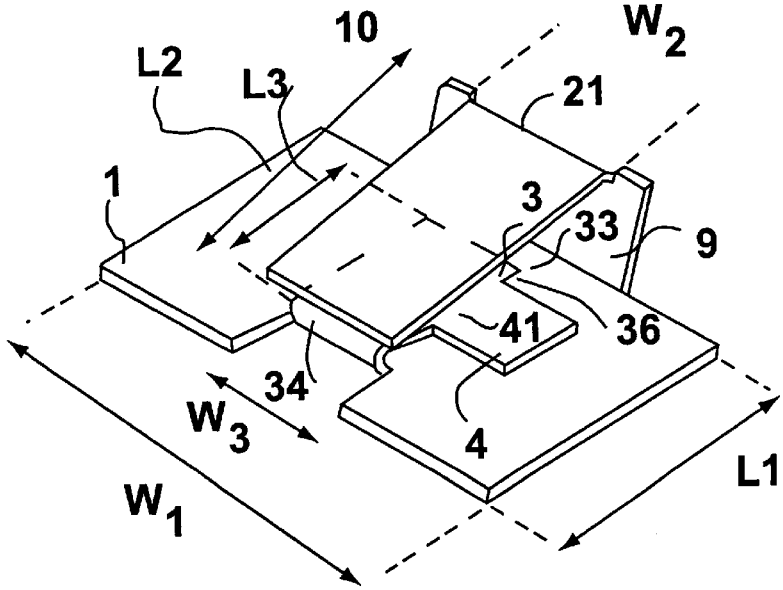
FIG. 6 shows an antenna device for multiple band operation, according to the invention.

In FIG. 6, a fourth embodiment of the invention is shown. This embodiment concerns an antenna device for multiple band operation. The conductive first plate or ground plane 1, the conductive second plate 2 and the conductive grounding means 9, essentially have the same shapes and functions as described above. The third plate 3 is provided with a fourth plate 4, preferably integral with the third plate 3. The fourth plate is rectangular or square, and is connected at one of its edges 41 to a portion of an edge 36 of the third plate. Said portion of the edge 36 is preferably located close to the edge 33, or closer to edge 33 then edge 34. The conductive third plate essentially has the same shape as described above, and essentially has the same function when operating in a first frequency band, e.g. 900 MHz. When operating in a second frequency band, e.g. 1800 MHz, the fourth plate 4 will radiate and perform an essential part of the radiating (and/or receiving) function of the antenna device, since it is essentially not covered or overlapped by the second plate. The fourth plate 4 is connected to the transceiver circuits of the radio communication device via the third plate 3 and its connection at feed portion 35 to said transceiver circuits.

For an antenna according to the embodiment of FIG. 6 to operate in the 900 MHz band and the 1800 MHz band the first plate 1 can have a width $W_1$ of about 70–120 mm, and a length $L_1$ of about 60–70 mm. Further the second plate 2 can have a width $W_2$ of about 35 mm, and a length $L_2$ of about 60 mm, while the third plate 3 can have a width $W_3$ of about 25 mm, and a length $L_3$ of about 37 mm. The distance between the first and third plates can be about 4 mm, the greatest distance between the first and second plates can be about 22 mm, and the angle $\alpha$ preferably is between 10° and 20°. The fourth plate 4 can be square with the sides having the length 20 mm. This is an example of a well functioning antenna device for operation in the said frequency bands, and which is to be mounted inside an automobile close to a window, e.g. in accordance to what is described in connection to FIGS. 7 and 8 below. However, many variations can be made within the scope of the invention.

Figure 7:
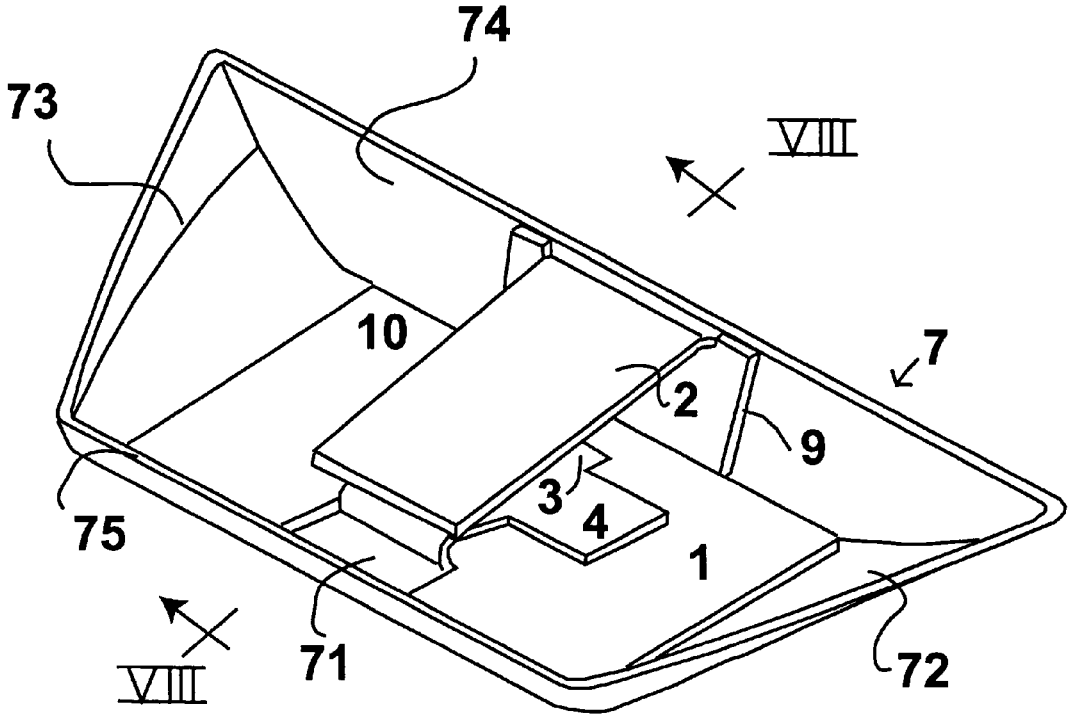
FIG. 7 shows an antenna device provided with a cover according to the invention.

In FIG. 7, an antenna device according to the invention with its cover 7 is shown. The cover is preferably trough shaped, and exhibits a bottom wall 71, two side walls 72, 73 a back wall 74 and a front wall 75. The walls or portions thereof, e.g. the bottom 71 and back 74 walls, can be metallised or covered with a conductive surface, which preferably is connected to signal ground. In this embodiment the first plate 1 is attached to the bottom wall 71 so as to form one unit.

Figure 8:
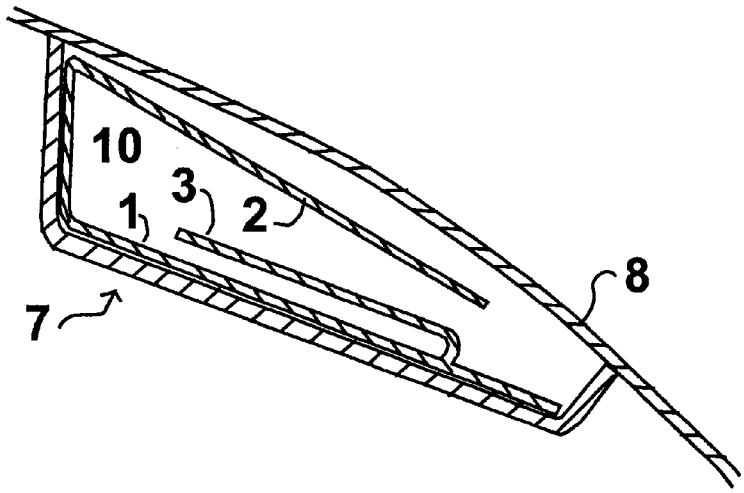
FIG. 8 is a section taken at VIII—VIII in FIG. 7.

In FIG. 8, which is a cross section of the embodiment of FIG. 7 taken at VIII—VIII, is shown how the antenna device is attached to a top portion of a wind screen 8 of an automobile. The edges of the walls 72, 73, 74 and 75 are shaped so that the cover will fit on the wind screen 8, which will cover the open side of the cover 7. Since the wind screens of modern automobiles often are dark at their top portions the inside of the cover and the antenna elements will not be seen. Alternatively, e.g. for automobiles not having dark top portions, the open side can be covered with a non-transparent or dark lid, preferably fastened to the walls of the cover. This lid can be provided with an adhesive, e.g. a double sided adhesive tape, on the side facing away from the cover. The adhesive is used to fasten the antenna device to the wind screen 8.

Further the housing can incorporate radio circuitry for processing incoming/outgoing signals. Also further antenna devices can be incorporated in the housing. For example, further antenna(s) for operation in other frequency bands and/or other antennas e.g. for navigation systems, such as GPS can be incorporated in the housing.

Figure 9:
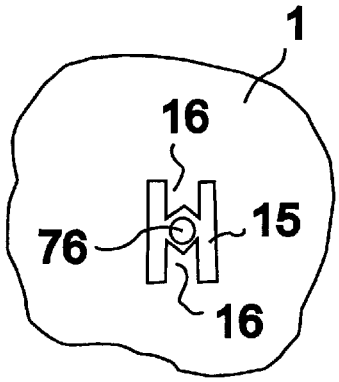
FIG. 9 is enlarged top view of a portion of the first plate provided with fastening means.
Figure 10:
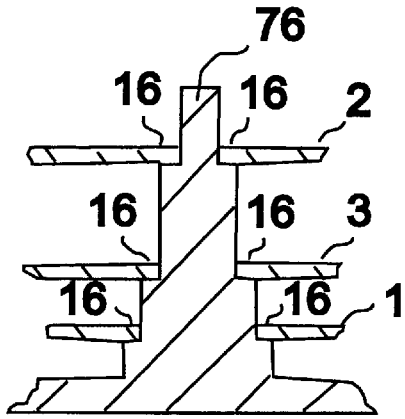
FIG. 10 shows an enlarged section through a protrusion for fastening and stabilising the first, second and third plates.
Figure 12:
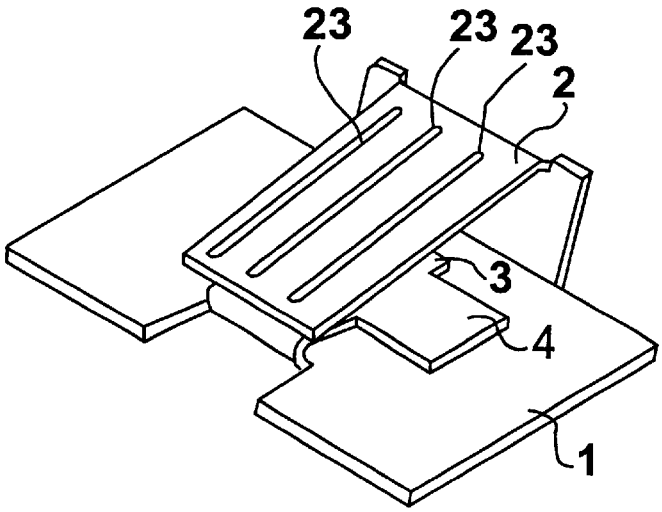
FIG. 12 shows an alternative embodiment of an antenna device according to the invention where the second plate is provided with stabilizing longitudinal grooves.

The conductive plates can be fastened to the cover in many different ways, e.g. the conductive grounding means 9 or the first 1 or second 2 plates can be attached to the cover. This can be accomplished by means of an adhesive. However, a preferred method for the fastening is to use protrusions 76, preferably slightly conical, protruding from the cover, and passing through holes 15 in e.g. the first plate. When the protrusions 76 are made of e.g. a thermoplastic material they can be deformed by melting, to secure the plate. Alternatively the holes or openings 15 in the plate can be provided with tongues 16 having V-shaped ends, being adapted to grip the preferably conical protrusion 76 in a locking action. This is shown in FIG. 9, which is enlarged top view of a portion of the first plate 1. When the protrusions are located so as to pass trough holes or openings 15 in more than one plate, e.g. the first 1, second 2 and third 3 plate, the stability of the antenna device is increased. In this case, it is advantageous if the protrusion is provided with annular shoulders and the holes or openings are adapted thereto, as shown in FIG. 10, which shows an enlarged section through a protrusion 76 to which the first, second and third plates are secured by means of said V-shaped tongues 16. Alternatively, for increasing the stability, an other dielectric than air can be used between the plates, e.g. a plastic or ceramic material. A further alternative for improvement of the stability is to provide one or more of the plates with longitudinal grooves extending in directions essentially perpendicular to first 21, second 22, third 33 and fourth 34 edges. In FIG. 12, it is shown how the second plate 2 is provided with such grooves 23.

Figure 11:
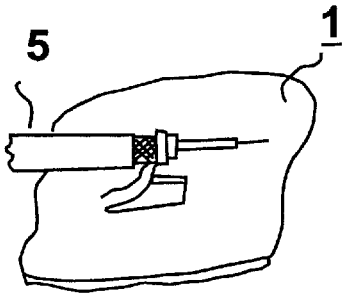
FIG. 11 shows an enlarged portion of the first plate provided with a ground connection means.

Further advantages with the manufacturing including stamping/punching can be found when tongues for the connection means at feed portion 35 and connection point 13 can be formed in the same stamping step as cuts out the plates. A tongue at connection point 13 can be included in a crimped connection where a conductive support ring is provided under the ground conductor and a crimp ring is crimped around the ground conductor and the tongue. This is shown in FIG. 11, which shows an enlarged portion of the first plate 1 from which a cut out tongue is crimped to the ground conductor of the transmission line. A tongue provided at feed portion 35 can be cut out from the third plate 3 or cut from the surrounding portion of the sheet to form a part separate from but integral with the third plate. This tongue can itself be crimped to the signal conductor.

Although the invention is described by means of the above examples, naturally many variations are possible within the scope of the invention. For example the first, second third, and fourth plates can have many different shapes than those described, and still provide the desired operation. The second plate can e.g. include at least one wedge-shaped portion, and possibly rounded corners.

What is claimed is:

1. An antenna device for a radio communication device, comprising:

a conductive first plate, having a first surface, being arranged to be connected to signal ground of the radio communication device, a conductive second plate, having first and second opposing edges partially defining a second surface of said second plate, being arranged spaced apart from the first plate, and said first and second surfaces facing each other, a conductive grounding means interconnecting the first and second plates at least along a portion of the first edge of the second plate, wherein a conductive third plate, having third and fourth opposing edges, being arranged between the first and second plates, and the third plate being provided with a feed portion, which is to be connected to circuitry of the radio communication device, whereby it is achieved that received/transmitted signals in a first frequency band are capacitively coupled between the second and third plates, and that the second plate essentially performs the radiating function of the antenna device in said first frequency band, the third edge is the edge of the third plate being arranged closest to the grounding means, and with a spacing therebetween and the fourth edge is connected to the first plate.

2. The antenna device according to claim 1, wherein the feed portion is located closest the third edge.

3. The antenna device according to claim 1, wherein the third plate is conductively connected to the first plate at least along a portion of the fourth edge of the third plate.

4. The antenna device according to claim 1, wherein the third plate is arranged on the first plate by means of a dielectric carrier, whereby a capacitive coupling between the third plate and signal ground is achieved.

5. The antenna device according to claim 1, wherein the first and third edges are essentially parallel.

6. The antenna device according to claim 1, wherein the third plate is located closer to the first plate than to the second plate.

7. The antenna device according to claim 1, wherein the third plate is fully overlapped by the second plate.

8. The antenna device according to claim 1, wherein the third plate is connected, at an edge, between opposing ends of the third and fourth edges, to a conductive fourth plate, whereby it is achieved that received/transmitted signals in a second frequency band are transmitted by the fourth plate and the first plate.

9. The antenna device according to claim 8, wherein the fourth plate is essentially not overlapped by the second plate.

10. The antenna device according to claim 8, wherein the second frequency band has a centre frequency approximately twice that of the first frequency band.

11. The antenna device according to claim 1, wherein the second plate is essentially rectangular, and the lengths of the first and second edges, respectively, are smaller than the distance between said edges.

12. The antenna device according to claim 1, wherein the first and second plates are essentially parallel.

13. The antenna device according to claim 1, wherein the first and second plates are essentially planar, and that the planes of respective plate intersect at an angle $\alpha$, where $0° < \alpha \leqq 45°$, and preferably $8° < \alpha \leqq 25°$.

14. The antenna device according to claim 13, wherein $\alpha$ is about 10°.

15. The antenna device according to claim 1, wherein the first, second, and third plates are formed from one conductive sheet, said first and fourth edges are formed by bent sections of said sheet.

16. The antenna device according to claim 15, wherein the third plate is cut out from a portion of the conductive sheet forming the first plate.

17. The antenna device according to claim 1, wherein at least one of the conductive plates is provided with stabilizing longitudinal grooves.

18. The antenna device according to claim 1, wherein a cover is attached to at least one of the first plate, the second plate, or the conductive grounding means, the cover having one open side, and covered with a lid, the cover being arranged to be attached with an open side towards a glass pane.

19. The antenna device according to claim 18, wherein the cover exhibits inner walls, whereof major portions are covered by a conductive ground surface.

20. The antenna device according to claim 1, wherein at least two of said conductive plates are mechanically secured to each other with a predetermined spacing by means of at least one dielectric support.

* * * * *